United States Patent [19]

Ulics

[11] Patent Number: 4,513,923

[45] Date of Patent: Apr. 30, 1985

[54] COMMODE TOILET TISSUE DISPENSER

[76] Inventor: George Ulics, 1300 Venice, Dearborn, Mich. 48124

[21] Appl. No.: 547,060

[22] Filed: Oct. 31, 1983

[51] Int. Cl.[3] ..... B65H 19/00; E04G 3/00

[52] U.S. Cl. ..... 242/55.2; 248/230; 4/300.1

[58] Field of Search ..... 242/55.2, 55.3, 55.53, 242/129.5, 129.6, 129.62; 4/300.1; 248/218.4, 219.2, 219.4, 230, DIG. 5; 24/455, 457, 458

[56] References Cited

U.S. PATENT DOCUMENTS

| | | | |
|---|---|---|---|
| 1,238,976 | 9/1917 | Zika | 248/230 |
| 3,005,614 | 10/1961 | Daniell | 248/230 |
| 4,179,077 | 12/1979 | Morishita | 242/55.2 |

*Primary Examiner*—Leonard D. Christian

*Attorney, Agent, or Firm*—Charles W. Chandler

[57] ABSTRACT

Means for mounting a roll of tissue on a tubular member of a commode frame, comprising a U-shaped bracket having a pair of legs with a roller for supporting the tissue between the legs, and a U-shaped clamp which embraces the tubular member. Fasteners connect the ends of the clamp to the mid-section of the bracket for mounting the tissue on the commode frame.

4 Claims, 4 Drawing Figures

COMMODE TOILET TISSUE DISPENSER

BACKGROUND OF THE INVENTION

This invention is related to toilet tissue dispensers, and more particularly to a holder for supporting a roll of toilet tissue on a tubular member such as the leg of a portable commode.

Commercially available portable commodes typically have a pot suspended from a frame formed of several tubular members connected together. Toilet tissue holders are not commercially available for such commodes. In addition, invalids frequently employ a portable frame that is mounted adjacent a conventional toilet bowl. Toilet tissue holders are not available for this type of frame. One of the reasons may be that such frames have several vertical tubular legs. It is difficult to fasten a holder on a tubular member in such a manner that it does not either slide down or twist around the leg as the roll of tissue is being used.

SUMMARY OF THE INVENTION

The broad purpose of the present invention is to provide means for supporting a roll of tissue on a tubular member. Preferrably a tissue dispenser bracket having a midsection with a pair of spaced openings is employed with a clamp for embracing the tubular member. The clamp has ends disposed adjacent the openings in the bracket, and fastener means connect the clamp to the midsection of the bracket.

In another embodiment of the invention, a commercially-available bracket is employed having a recessed mid-section. An insert is disposed in the recess. The insert has a curved portion complementing the curvature of the tubular member to form a spacer between the tubular member and the bracket. The clamp is then mounted around the tubular member, its ends being fastened to the bracket. Preferrably double-sided adhesive tape is wrapped around the tubular member before the clamp and the bracket are fastened together to prevent the bracket from either slipping along the leg or being turned about the leg.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
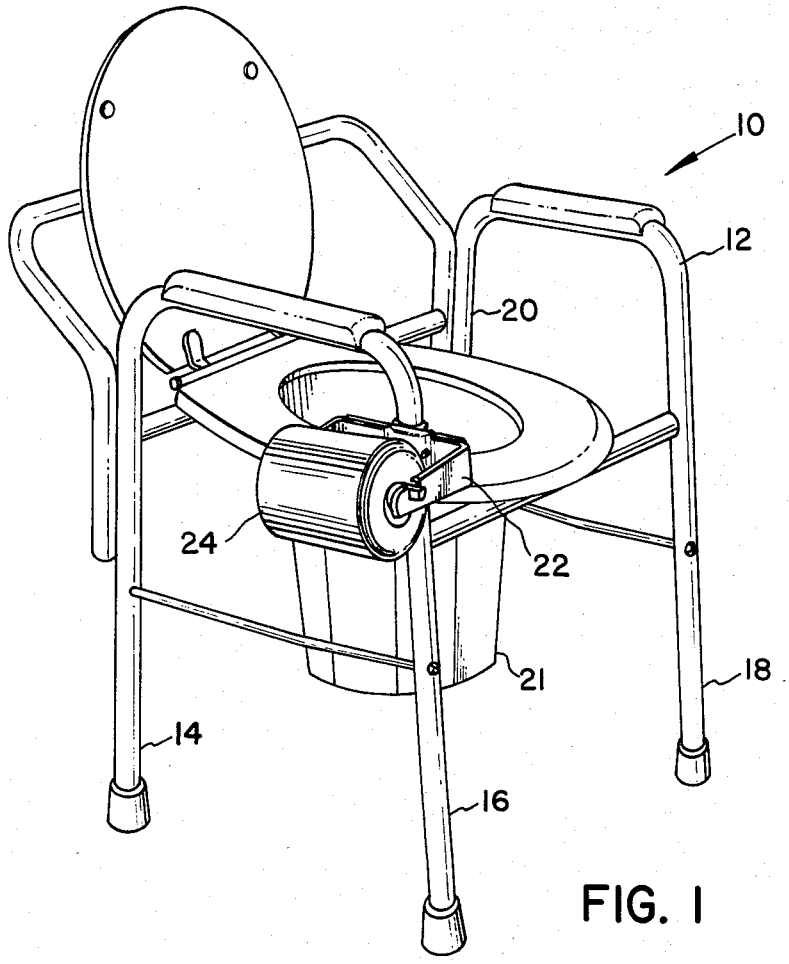
FIG. 1 is a perspective view of a conventional portable commode having a toilet tissue dispenser illustrating the preferred embodiment of the invention.

Referring to the drawings, FIG. 1 illustrates a conventional commode generally indicated at 10 having a frame 12 including tubular legs 14, 16, 18 and 20. A pot 21 is suspended from the frame in the conventional manner. Dispenser means 22, mounted on leg 16, support a roll of tissue 24.

Figure 2:
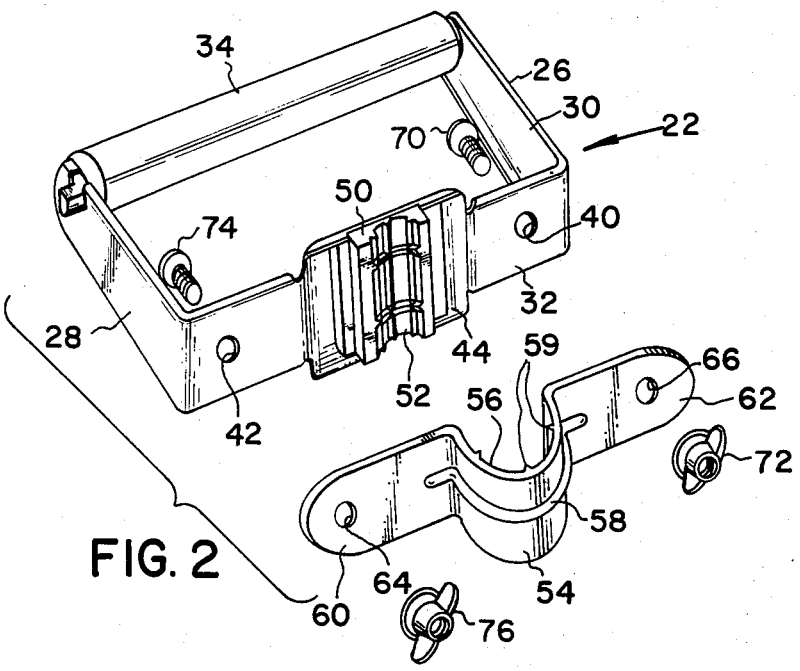
FIG. 2 is a partially exploded view of the tissue dispenser of FIG. 1.

Referring to FIG. 2, dispenser means 22 include a metal, U-shaped bracket 26, preferrably formed of a sheet metal stamping, and which is commercially available as a toilet tissue bracket. Bracket 26 has a pair of spaced, parallel legs 28 and 30 connected to opposite ends of a bight 32. A roll 34, adapted for receiving tissue 24, has its ends connected to the ends of legs 26 and 28.

Figure 3:
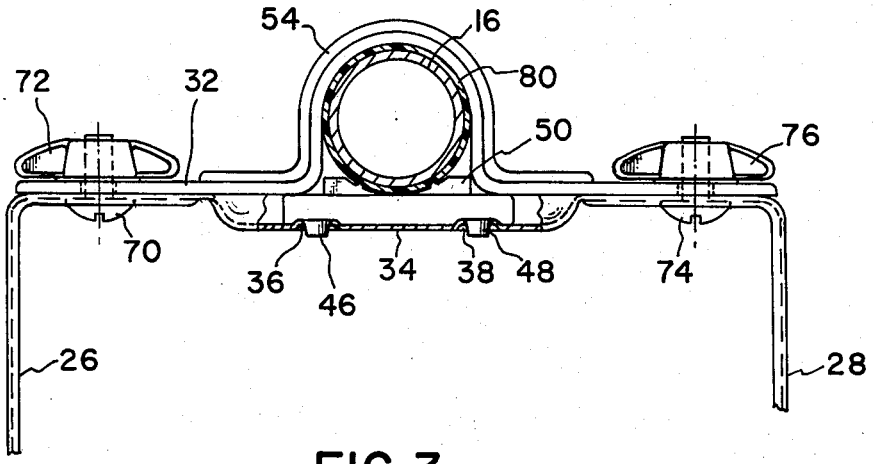
FIG. 3 is a sectional view of the dispenser bracket fastened to the tubular member.

Referring to FIG. 3, bight 32 has a recessed midsection 34 with a pair of screw-receiving openings 36 and 38. The bight also has a second pair of screw-receiving openings 40 and 42 spaced on opposite sides of midsection 34.

Insert 44, preferably formed of a plastic material, is mounted in recessed midsection 34 of the bracket. The insert has a length generally corresponding to the length of the recessed midsection, and a pair of bulges 46 and 48 which snap into openings 36 and 38 to connect the insert to the bracket. The thickness of the insert body corresponds to the depth of the recessed midsection.

The insert also has a raised section 50 with a groove 52 curved to accommodate the curvature of tubular leg 16. The groove has several, sharp rib means 52A parallel to the axis of groove 52, and several, sharp rib means 52B at right angles to rib means 52A. Rib means 52A resist any tendency of the bracket to slide on a tubular support, while rib means 52B resist any tendency of the bracket from turning on such a support.

A clamp 54, preferably formed of a plastic material, has a curved midsection 56 adapted to embrace the tubular leg, as best illustrated in FIG. 3. The midsection has a ridge 58 which functions to reinforce the clamp, and rib means 59 to prevent the clamp from twisting on a tubular support. The clamp has a pair of ends 60 and 62 disposed adjacent openings 40 and 42 of the bracket, in such a position that opening 64 in the clamp is aligned with opening 42 of the bracket, and opening 66 in the clamp is aligned with opening 40 of the bracket.

A threaded fastener 70 is inserted in openings 40 and 66 and connected to wing nut 72 to fasten one end of the clamp to the bracket. A second threaded fastener 74 and wing nut 76 are connected through opening 42 abd 64 to fasten together the opposite ends of the clamp and the bracket. Preferrably double sided tape 80 is wrapped around tubular leg 16 so that the tape is adhesively fastened to the tubular leg as well as to the clamp. Thus when the clamp is fastened to the bracket, the insert and the clamp cooperate with the tape to prevent the clamp from being slid together along the length of the leg or twisted around the leg.

Figure 4:
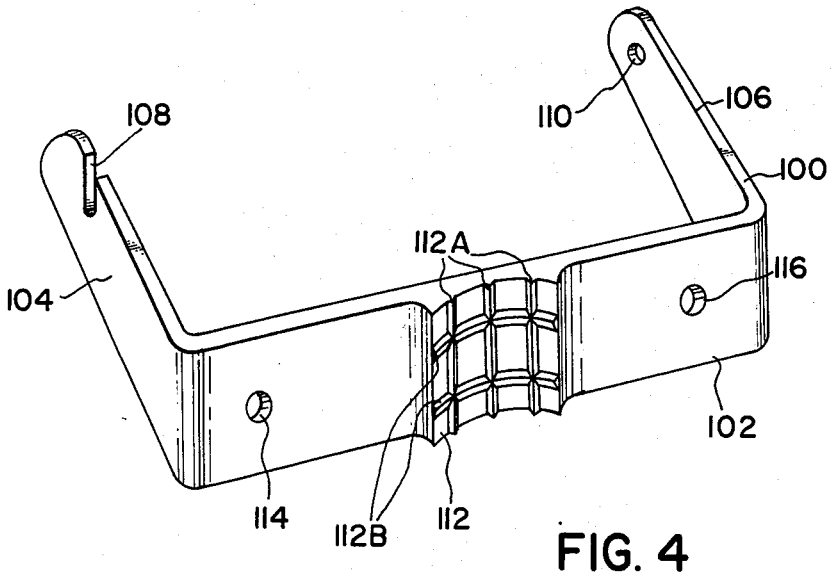
FIG. 4 is a perspective view of another embodiment of the bracket.

FIG. 4 illustrates another bracket 100, also formed of a stamping, and having a bight 102 and a pair of parallel legs 104 and 106. Leg 104 has a slot 108 and leg 106 has an opening 110 for receiving roller 34. The bracket midsection also has a screw receiving opening 114 adjacent leg 104, and another screw receiving opening 116 adjacent leg 106 for receiving fasteners 70 and 74. The midsection of the bracket has a raised portion 112 provided with a curved surface that is complementary with the curvature of tubular leg 16. The curved surface has ribs 112A for preventing twisting of the bracket on the support, and ribs 112B for preventing sliding along the support.

This embodiment of the bracket combines a function of supporting the tissue as well as having an integral insert for engaging a tubular leg. It is employed with clamp 54 which is fastened around the double sided tape and the tubular leg to support a roll of tissue.

It is to be understood that I have described a toilet tissue dispenser that can be quickly mounted on a tubular frame whether it be employed for a portable commode or an invalid frame for a conventional toilet.

Having described my invention, I claim:

1. Means for mounting a roll of tissue on a commode having a tubular member comprising:

a U-shaped bracket having a pair of spaced legs and an elongated bight;

roller means suitable for supporting a roll of tissue, the ends of the roller means being releasably connected to the bracket legs such that the roller means spans the two legs;

the bight of the bracket having a plurality of longitudinally spaced openings adapted to receive fastener means;

an insert engaging the bight of the bracket and having a pair of bulges received in a first pair of said openings in the bracket, the insert having a groove with a curvature complementing the curvature of the tubular member;

a clamp having a midsection embracing the tubular member, and a pair of ends adjacent a second pair of said openings in the bracket; and fastener means received in the second pair of openings to connect the clamp to the bight of the bracket.

2. Means as defined in claim 1, in which the first pair of openings are disposed between the second pair of openings in the bracket.

3. Means as defined in claim 1, including tape wrapped around the tubular member, the tape having adhesive on opposite sides thereof and being disposed between the insert and the clamp to prevent the bracket from being moved with respect to the tubular member at such times as the clamp is connected to the bracket.

4. Means as defined in claim 1, in which the bracket has a recessed midsection in its bight, and the insert is disposed in the recessed midsection.

* * * * *